US010271595B2

(12) United States Patent
Klatt et al.

(10) Patent No.: US 10,271,595 B2
(45) Date of Patent: Apr. 30, 2019

(54) SLEEVED BLANKET FOR SWADDLING AND BEDDING INFANTS

(71) Applicant: Alan Paige Enterprises Inc., Calgary (CA)

(72) Inventors: Nicole Klatt, Calgary (CA); Ryan Klatt, Calgary (CA)

(73) Assignee: Alan Paige Enterprises Inc., Calgary (CA)

( * ) Notice: Subject to any disclaimer, the term of this patent is extended or adjusted under 35 U.S.C. 154(b) by 132 days.

(21) Appl. No.: 15/366,117

(22) Filed: Dec. 1, 2016

(65) Prior Publication Data

US 2017/0150761 A1 Jun. 1, 2017

Related U.S. Application Data

(60) Provisional application No. 62/261,550, filed on Dec. 1, 2015.

(51) Int. Cl.
*A41D 15/04* (2006.01)
*A41B 13/06* (2006.01)
(Continued)

(52) U.S. Cl.
CPC ..... *A41D 15/04* (2013.01); *A41B 13/06* (2013.01); *A41B 13/10* (2013.01); *A41D 1/215* (2018.01); *A41D 3/08* (2013.01); *A47G 9/0223* (2013.01)

(58) Field of Classification Search
CPC ..... A41B 13/00; A41B 13/06; A41B 13/08; A41B 13/10; A41D 3/08; A47G 9/0223
(Continued)

(56) References Cited

U.S. PATENT DOCUMENTS 4,651,349 A * 3/1987 Heiler ..... A41D 1/215 2/104
4,964,172 A * 10/1990 Bollard ..... A41D 1/215 2/104
(Continued)

OTHER PUBLICATIONS

Successful Transfer of a Sleeping Toddler. TwiceLovedAndModern, Full Youtube video. Published Aug. 21, 2015. Last retrieved Dec. 4, 2018. http://www.youtube.com/watch?v=iZINeG97Mgg.*
(Continued)

*Primary Examiner* — Richale L Quinn
*Assistant Examiner* — Anne M Kozak
(74) *Attorney, Agent, or Firm* — Kyle R Satterthwaite; Ryan W Dupuis; Ade & Company Inc.

(57) ABSTRACT

A sleeved blanket useful for holding an infant features a sleeve, and a blanket spanning to one side thereof. The blanket has an extension reaching longitudinally beyond the sleeve to enable folding of the blanket extension across a torso anterior of the caregiver from the worn sleeve on one arm and over the opposing shoulder. Unique methods of transitioning an infant from a swaddled state to a laid down position are disclosed, along with unique nursing applications for the sleeved blanket. A neck strap is worn across the backside of the neck and over the unsleeved shoulder to help balance the worn position of the sleeve, and features stimuli for the infant, fastening or toy-carrying elements, and/or a burp/split-up cloth. The sleeve includes a shoulder portion to better maintain the worn position, and gripping elements are provided on the sleeve and/or blanket to help maintain useful positions thereof during use.

19 Claims, 12 Drawing Sheets

(51) Int. Cl.

| | |
|---|---|
| ***A41B 13/10*** | (2006.01) |
| ***A47G 9/02*** | (2006.01) |
| ***A41D 3/08*** | (2006.01) |
| ***A41D 1/215*** | (2018.01) |

(58) Field of Classification Search
USPC ..... 2/104
See application file for complete search history.

(56) References Cited

U.S. PATENT DOCUMENTS

| | | | | |
|---|---|---|---|---|
| 5,005,217 | A * | 4/1991 | Bern | A41D 1/215 2/104 |
| 6,216,273 | B1 * | 4/2001 | Williams | A41D 1/215 2/104 |
| 6,301,713 | B1 * | 10/2001 | Aceves | A41D 1/205 2/104 |
| 6,536,047 | B1 * | 3/2003 | Mullaly | A41B 13/06 2/48 |
| 6,918,148 | B2 * | 7/2005 | Auxila | A47D 13/083 2/16 |
| 6,986,163 | B2 * | 1/2006 | Dugan | A41B 13/06 2/48 |
| 7,048,160 | B2 * | 5/2006 | Anderson | A47D 13/02 224/148.6 |
| D591,483 | S * | 5/2009 | Petti | D2/823 |
| 7,685,648 | B2 * | 3/2010 | Kenney | A41D 13/04 2/48 |
| 7,765,613 | B2 * | 8/2010 | Carr | A41F 15/002 2/104 |
| 8,225,442 | B2 * | 7/2012 | Davis | A41D 15/04 5/655 |
| 8,776,265 | B2 * | 7/2014 | Neveu | A47G 9/068 2/69.5 |
| 9,003,565 | B1 * | 4/2015 | Leach | A41D 1/215 2/104 |
| 9,433,243 | B1 * | 9/2016 | Blakeney | A41B 13/103 |
| D775,815 | S * | 1/2017 | Halverstadt; Matthew C | D3/214 |

OTHER PUBLICATIONS

NuRoo Pocket Demo. NuRoo Baby, Full YouTube video. Published Dec. 2, 2013. Last retrieved Dec. 4, 2018. http://www.youtube.com/watch?v=leGz2lbUfQE.*

The CuddlyWrap™ Premature/Newborn Removing Baby. cuddlywrap, Full YouTube video. Published Jul. 12, 2010. Last retrieved Dec. 4, 2018. http://www.youtube.com/watch?v=UOquwZqJ67I.*

Getting a Sleeping Baby Out of A Stretchy Wrap. Wild Was Mama, Full YouTube video. Published Aug. 26, 2015. Last retrieved Dec. 4, 2018. http://www.youtube.com/watch?v=y4yU7Ch2G7o&t=2s.*

Remove a baby from a pouch. theslingsisters, Full YouTube video. Published 25 Oct. 2010. Last retrieved 4 Dec. 2018. http://www.youtube.com/watch?v=JtltLWdBeks.*

How to Put a Baby to Sleep in a Crib. EnfamilHowTo, Full YouTube video. Published 5 Nov. 2015. Last retrieved 4 Dec. 2018. http://www.youtube.com/watch?v=AIDd6SmpXaw.*

* cited by examiner

SLEEVED BLANKET FOR SWADDLING AND BEDDING INFANTS

CROSS REFERENCE TO RELATED APPLICATIONS

This application claims benefit under 35 U.S.C. 119(e) of Provisional Application Ser. No. 62/261,550, filed Dec. 1, 2015, the entirety of which is incorporated herein

FIELD OF THE INVENTION

The present invention relates generally to a sleeved blanket, and more particularly a sleeved blanket used to hold and/or wrap an infant in the caregiver's arms, while allowing the blanket to fold up over the caregiver's shoulder to keep the caregiver's hands free of the blanket material while laying the infant down, leaving the infant without the blanket while at the same time keeping the blanket intact with the caregiver.

BACKGROUND

It is a commonly known practice to swaddle or wrap an infant in a blanket or other fabric or material to provide a feeling of security and warmth. They also like the cozyness that a blanket offers under there head (neck, chin) instead of just a bare arm. This adds comfort for both the child and the caregiver. Typically, a caregiver holds an infant with a four corner blanket that is wrapped and secured around the infant. The caregiver's problematic occurrence is trying to retrieve the infant's blanket before or after the caregiver attempts to lay the infant down in a sleeping state. The blanket usually is under the infant's body, and to retrieve a standard blanket, the caregiver has to cause movement and disturbance to the resting infant to free the blanket from therefrom. This results in a greater chance of the infant waking from sleep.

The American Academy of Pediatrics recommends that parents keep blankets out of an infant's crib until they are at least twelve months of age. Many infants who die from SIDS (sudden infant death syndrome) are found on their stomach with their faces covered by soft bedding such as blankets and pillows.

Accordingly, there is a desire for an improved solution for transitioning a sleeping infant with minimal disruption from a swaddled condition wrapped in a blanket to a bedded position free of the blanket.

Applicant has developed a sleeved blanket product that addresses the forgoing problem, while also providing several other unique and advantageous features not heretofore seen in sleeved blanket products of the prior art.

SUMMARY OF THE INVENTION

According to one aspect of the invention there is provided a method of holding and bedding an infant, the method comprising:

(a) possessing of a sleeved blanket by a caregiver, the sleeved blanket comprising a sleeve and a blanket attached thereto;

(b) wearing of the sleeve in a worn position on one arm of the caregiver and the infant's body covered by or wrapped in the blanket attached to said sleeve;

(c) putting the infant to bed by:

(i) withdrawing the blanket from around the infant's body while leaving the infant's head in place on the sleeve worn on said one arm of the caregiver;

(ii) with the blanket removed from the infant's body, laying the infant down onto a sleep surface using two hands, including gently transferring the infant's head to said sleeping surface from the sleeve worn on said one arm of the caregiver;

(iii) with the sleeve remaining in the worn position, removing said two hands away from the infant laid on the sleeping surface, including withdrawing said one arm of the caregiver away from the infant laid on said sleeping surface, thereby simultaneously withdrawing both the sleeve and the blanket attached thereto.

Step (b) preferably comprises donning the sleeve in the worn position on said one arm of the caregiver, laying a portion of the blanket over a shoulder of the caregiver that opposes said one arm on which the sleeve is worn, cradling the infant in said one arm of the caregiver with the infant's head on the sleeve worn on said one arm, and lowering said portion of the blanket from off said opposing shoulder and over the infant's body.

Step (c)(i) preferably comprises lifting of the blanket from the infant's body and placing the portion of said blanket over the shoulder of the caregiver, and step (c)(ii) comprises leaving the portion of said blanket over said shoulder to keep the blanket free of said sleeping surface during placement of the infant thereon.

Step (c)(iii) may comprise using at least one grip member on the portion of the blanket to frictionally retain said portion of the blanket in place over said shoulder during placement of the infant on the sleeping surface, said at least one grip member having a greater coefficient of friction than a surface of said blanket on which said at least one grip member is disposed.

Step (b) may comprise wearing a neck strap across the backside of the neck from the sleeve on said one arm and over a shoulder of the caregiver that opposes said one arm to help balance the sleeve in the worn position on said one arm.

The method may include, prior to step (c), stimulating the infant using one or more stimuli on the neck strap that is visually or tactilely accessible to the infant.

The method may include using a shoulder spanning portion of the sleeve to perform, or contribute to, retention of the sleeve in the worn position.

The method may include using a gripping element to perform, or contribute to, retention of the sleeve in the worn position, the gripping element being mounted internally of the sleeve and having a higher coefficient of friction than an interior surface of the sleeve to which the gripping element is mounted.

According to a second aspect of the invention, there is provided a sleeved blanket useful for holding of an infant by a caregiver, the sleeved blanket comprising:

a sleeve having first and second ends spaced apart in a longitudinal direction and a hollow interior spanning longitudinally between a first opening at the first end of the sleeve and a second opening at the second end of the sleeve;

a blanket spanning laterally outward from the sleeve to one side thereof, the blanket comprising a main blanket body attached to the sleeve over a longitudinal span thereof and a blanket extension joined to the main body at an end thereof nearest the first end the sleeve, the extension reaching beyond the first end of the sleeve in the longitudinal direction, whereby with the sleeve in a worn position on a first arm of a caregiver, a distal end of the blanket extension situated longitudinally opposite the main blanket body is foldable across a torso anterior of the caregiver and over a shoulder of a second arm of the caregiver.

Preferably the sleeve is shaped to provide a shoulder worn area thereof overlying a shoulder of the arm of the caregiver so as to hang the sleeve in the worn position from said arm.

Preferably an end of the main blanket body opposite the extension resides nearer to the second end of the sleeve than to the first end of the sleeve.

Preferably the blanket terminates at or prior to the second end of the sleeve.

Preferably a width of the blanket measured perpendicularly transverse to the longitudinal direction is less than a full length of the blanket in said longitudinal direction.

Preferably a width of the blanket measured perpendicularly transverse to the longitudinal direction is less than a full length of the sleeve in said longitudinal direction.

Preferably there is at least one grip member attached to the blanket extension, wherein said at least one grip member has a greater coefficient of friction than a surface of said blanket extension on which said at least one grip member is disposed in order to frictionally retain the blanket extension in a folded position over the shoulder of the second arm of the caregiver.

Preferably there is at least one a gripping element mounted internally of the sleeve at the shoulder worn area thereof and having a higher coefficient of friction than an interior surface of the sleeve to which the gripping element is mounted to frictionally retain the sleeve in the worn position.

Preferably there is a neck strap attached to the sleeve at or adjacent the first end thereof for reaching across a neck of the caregiver at a posterior side thereof, and reaching anteriorly over the shoulder of the second arm.

Preferably there is at least one of:

(i) visual stimuli on the neck strap at or adjacent a free end thereof that is distal to the sleeve for visual stimulation of the infant;

(ii) a material that is attached to or comprised by the neck strap and is tactilely distinct from the sleeve and the blanket to provide tactile stimuli to the infant;

(iii) a coupling element carried on the neck strap for selective attachment and detachment of a toy or accessory thereto and therefrom;

(iv) a toy or accessory attached to the neck strap;

(v) a fastening member on the neck strap operable to couple the neck strap to the blanket; and (vi) a burp/spit-up cloth attached to the neck strap.

The burp/spit-up cloth may be detachable and re-attachable to the neck strap.

The burp/spit-up cloth may close around the neck strap and be slidable back and forth therealong to adjust a position of the burp/spit-up cloth.

As an alternative to the inclusion of a fastening member on the neck strap, the neck may be strap free of any means for attachment thereof to the blanket, whereby a free-hanging weight of the strap at a front torso of the caregiver counteracts sliding of the sleeve down the first arm of the caregiver to hold the sleeve in place.

According to a third aspect of the invention, there is provided a sleeved blanket useful for holding of an infant by a caregiver, the sleeved blanket comprising:

a sleeve having first and second ends spaced apart in a longitudinal direction and a hollow interior spanning longitudinally between a shoulder opening at the first end of the sleeve and a second opening at the second end of the sleeve;

a blanket attached to the sleeve for covering or wrapping of the infant by said blanket while said sleeve is worn on an arm of the caregiver with the infant's head rested on said sleeve;

wherein the first end of the sleeve is shaped to provide a shoulder worn area thereof overlying a shoulder of the arm of the caregiver so as to hang the sleeve in the worn position from said arm.

The sleeve preferably has a greater sleeve length at an outer side of the sleeve situated opposite the blanket such that the greater sleeve length of outer side reaches onto the shoulder of the caregiver to hang the sleeve in the worn position from said arm.

According to a fourth aspect of the invention, there is provided a sleeved blanket useful for holding of an infant by a caregiver, the sleeved blanket comprising:

a sleeve having first and second ends spaced apart in a longitudinal direction and a hollow interior spanning longitudinally between a first opening at the first end of the sleeve and a second opening at the second end of the sleeve;

a blanket attached to the sleeve for covering or wrapping of the infant by said blanket while said sleeve is worn on a first arm of the caregiver with the infant's head rested on said sleeve; and at least one of either:

a gripping element mounted internally of the sleeve and having a higher coefficient of friction than an interior surface of the sleeve to which the gripping element is mounted to frictionally retain the sleeve in the worn position or at least one grip member attached to the blanket at a blanket extension thereof that reaches beyond the first end of the sleeve in the longitudinal direction, wherein said at least one grip member has a greater coefficient of friction than a surface of said blanket extension on which said at least one grip member is disposed so as to frictionally retain the blanket extension in a folded position over a shoulder of a second arm of the caregiver.

According to a fifth aspect of the invention, there is provided a sleeved blanket useful for holding of an infant by a caregiver, the sleeved blanket comprising:

a sleeve having first and second ends spaced apart in a longitudinal direction and a hollow interior spanning longitudinally between a first opening at the first end of the sleeve and a second opening at the second end of the sleeve;

a blanket attached to the sleeve for covering or wrapping of the infant by said blanket while said sleeve is worn on a first arm of the caregiver with the infant's head rested on said sleeve; and a neck strap attached to the sleeve at or adjacent the first end thereof for reaching first across a neck of the caregiver at a posterior side thereof and then anteriorly over a shoulder of a second arm of the caregiver.

According to a sixth aspect of the invention, there is provided a sleeved blanket system comprising:

a sleeved blanket including:

a predefined flexible sleeve having first and second ends spaced apart in a longitudinal direction and a hollow interior spanning longitudinally between a first opening at the first end of the sleeve and a second opening at the second end of the sleeve; and a blanket attached to the sleeve for covering or wrapping of the infant within said blanket while said sleeve is worn on an arm of the caregiver with the infant's head rested on said sleeve; and an insert that is (i) selectively insertable into the sleeve to achieve an expanded state thereof in which the first and second openings are obstructed by the insert and collapse of the hollow interior is blocked by the insert received therein, and (ii) selectively removable from the sleeve to enable self-collapse of the flexible sleeve upon itself or receipt of a person's arm through the sleeve;

whereby the sleeved blanket is usable in a worn position with the flexible sleeve closing around the person's arm and the blanket draped over or wrapped around a body of an infant cradled in said arm with a head of the infant on the sleeve, and in a floor laid position with the sleeve in the expanded state to form a chest-propping support for an infant laid chest-down over the sleeve and attached blanket.

According to a seventh aspect of the invention, there is provided a method of using the forgoing system, the method comprising:

placing the insert within the sleeve to achieve the expanded state thereof and laying the insert and blanket on a ground surface with the blanket reaching out to one side of the sleeve;

placing the infant atop the sleeved blanket with feet of said infant atop the blanket and a torso of said infant spanning chest-down over the expanded sleeve from one side thereof to another with arms of the infant on a side of the expanded sleeve opposite the blanket, whereby the expanded sleeve elevates an upper torso and head of the infant above the ground surface while providing the arms of the infant with access to said ground surface.

According to an eighth aspect of the invention there is provided a method of using a sleeved blanket as a nursing cover, said method comprising, pulling a sleeve of the sleeved blanket onto a first arm of the caregiver and draping a neck strap of the sleeved blanket across a backside of the caregiver's neck from the sleeve and over a shoulder of a second arm of the caregiver, initially leaving a blanket of the sleeved blanket to simply hang down from the sleeve on the first arm, then lifting up and cradling an infant in the first arm of the caregiver with the infant's head resting on the worn sleeve, and then using a hand of the second arm to draw the blanket up and drape the blanket over the shoulder of the second arm, thereby passing the blanket over the infant into a position concealing the infant against a chest of the caregiver for private nursing of the infant from a breast of the caregiver behind said blanket.

According to a ninth aspect of the invention there is provided a method of using a sleeved blanket as a car seat cover, said method comprising, laying a blanket of said sleeved blanket out across an open front/top side of a car seat and tying a neck strap and said blanket together behind a rear side of the car seat to secure said blanket body over said front/top side of the car seat.

Laying the blanket out across an open front/top side of a car seat preferably comprises laying a main blanket portion of said blanket thereacross, and tying the neck strap and the blanket together comprises tying an extension portion of said blanket to the neck strap.

The method may comprise creating or leaving an opening between the blanket body and a top rim of the open top/front area of the car seat to enable deployment of a carry handle of said car seat away from said top rim into a useful position standing upright from the car seat over the open top/front area thereof for manual carrying of the car seat while still covering a remainder of the open top/front side of the car seat below said deployed carry handle.

BRIEF DESCRIPTION OF THE DRAWINGS

One embodiment of the invention will now be described in conjunction with the accompanying drawings in which:

FIG. 10A shows a front view of the car seat with the sleeved blanket in a partial-cover state over same, FIG. 10B shows a front side perspective view of the car seat with the sleeved blanket in a full-cover state over same, and FIG. 10C shows a rear view of the car seat illustrating tied securing of the sleeved blanket around the rear side thereof.

In the drawings like characters of reference indicate corresponding parts in the different figures.

DETAILED DESCRIPTION

In brief, disclosed herein is a product used to hold and or wrap an infant in the caregiver's arms, but also keeping the caregiver hands free of the blanket's material while laying the infant down, during which the blanket remains intact with the caregiver, thereby leaving the infant without the blanket so that it cannot present a hazard to the sleeping infant. The product is a single-sleeved blanket used to wrap, cuddle and hold an infant while allowing the caregiver to be able to release the infant from the held and wrapped position into a laid down sleeping position without the blanket, and without causing major disturbance of the infant during this transition. The blanket also enables both hands to be free for use while laying the infant down, thereby enabling confident handling of the infant. The sleeved area of the blanket acts as a cushion between the infant and the caregiver's arm to add extra comfort for both the infant and the caregiver in the infant-holding position.

Figure 6:
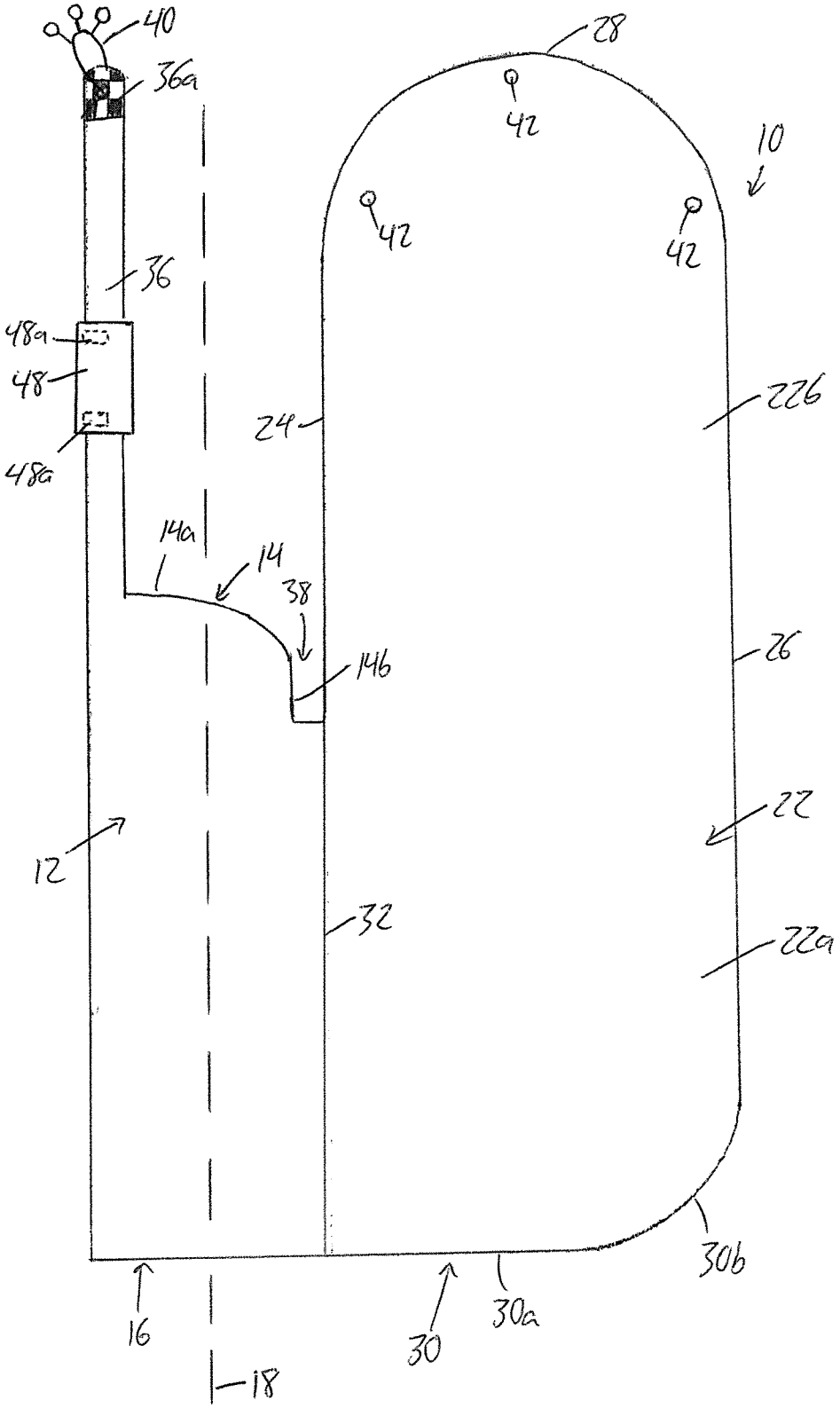
FIG. 6 is an overhead plan view of the sleeved blanket laid out flat to better illustrated the general shape and form thereof.

With reference to FIG. 6, which shows the sleeved blanket 10 laid out flat on the ground or other horizontal surface, the single-sleeved blanket 10 features a sleeve 12 having a first end 14 and a second end 16 disposed thereopposite in a longitudinal direction denoted by axis 18. The sleeve has respective first and second openings at the first and second ends to enable receipt of a caregiver's arm through the sleeve. The second opening is visible is some of the figures and labeled with reference character 20. A blanket 22 has an elongated shape of greater dimension in the longitudinal direction than in a width direction measured perpendicularly transverse thereto. Two longitudinal edges 24, 26 of the blanket 22 lie parallel to the longitudinal axis 18 of the sleeve. A first rounded end 28 of the blanket 22 resides longitudinally beyond the first end 14 of the sleeve, and arcuately interconnects the two longitudinal edges 24, 26 of the blanket 22. A second end 30 of the blanket interconnects the two longitudinal edges 24, 26 at a position generally aligned with the second end 16 of the sleeve, and as shown may feature a straight linear segment 30 emanating out from the sleeve, and a rounded corner 30*b* joining up with the longitudinal edge 26 furthest from the sleeve 12. While the illustrated blanket features a rounded first end and straighter second end, and a uniform-width parallel-sided (i.e. rectangular) center portion between these ends, it will be appreciated that the specific perimeter shape of the blanket may vary.

The blanket 22 is sewn to an exterior of the sleeve along one of the blanket's two longitudinal sides 22, 24, thus forming a seam 32 that lies parallel the sleeve's longitudinal axis 18 and attaches the blanket t the sleeve. The width of the blanket 22 thus spans laterally out from the sleeve to one side thereof, while the length of the blanket exceeds that of the sleeve in the longitudinal direction so as to reach longitudinally beyond the first end 14 thereof, but in the case of the illustrated embodiment, without extending beyond the second end 16 of the sleeve. The portion of the blanket that is seamed to the sleeve is referred to herein as a main body 22*a* of the blanket (or blanket body), with the remainder of the blanket that extends longitudinally from the blanket body beyond the first end 14 of the sleeve 12 being referred to as an extension 22*b* of the main blanket body, or a 'blanket extension'.

The side of the sleeve 12 to which the blanket body 22*a* is attached is referred to herein as the inner side of the sleeve, as it faces toward the torso of the caregiver when the sleeve is worn on one arm of the caregiver. At the opposing outer side 34 of the sleeve, a neck strap 36 of lesser width than the sleeve itself extends longitudinally from the sleeve's first end 14, and in the case of the illustrated embodiment, reaches longitudinally as far as the rounded first end 28 of the blanket extension 22*b*. The outer side 34 of the sleeve is greater in length than the opposing inner side thereof in the longitudinal direction. In the illustrated embodiment, the first end 14 of the features a smoothly curved initial profile 14*a* that gradually and convexly curves toward the shorter inner side of the sleeve from the longer outer side 34 thereof, followed by a step-like second profile 14*b* that steps down from the inner end of the curved profile 14*a* to join up with the shorter inner side of the sleeve at the respective end of the sleeve/blanket seam 28. This stepped profile leaves a rectangular notch or cut-out 38 between the blanket 22 and the curved profile of the sleeve end.

Figure 1:
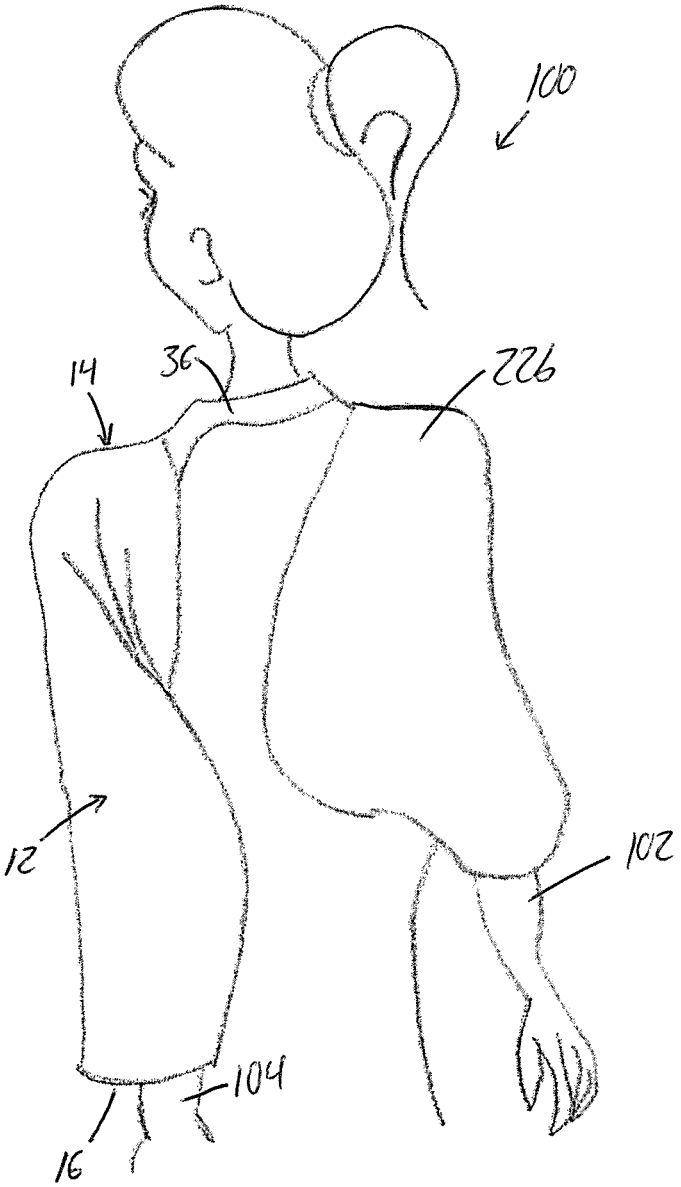
FIG. 1 is a rear elevational view showing a sleeved blanket of the present invention being worn by a caregiver with a blanket extension of the sleeved blanket slung over a shoulder of the user.
Figure 2:
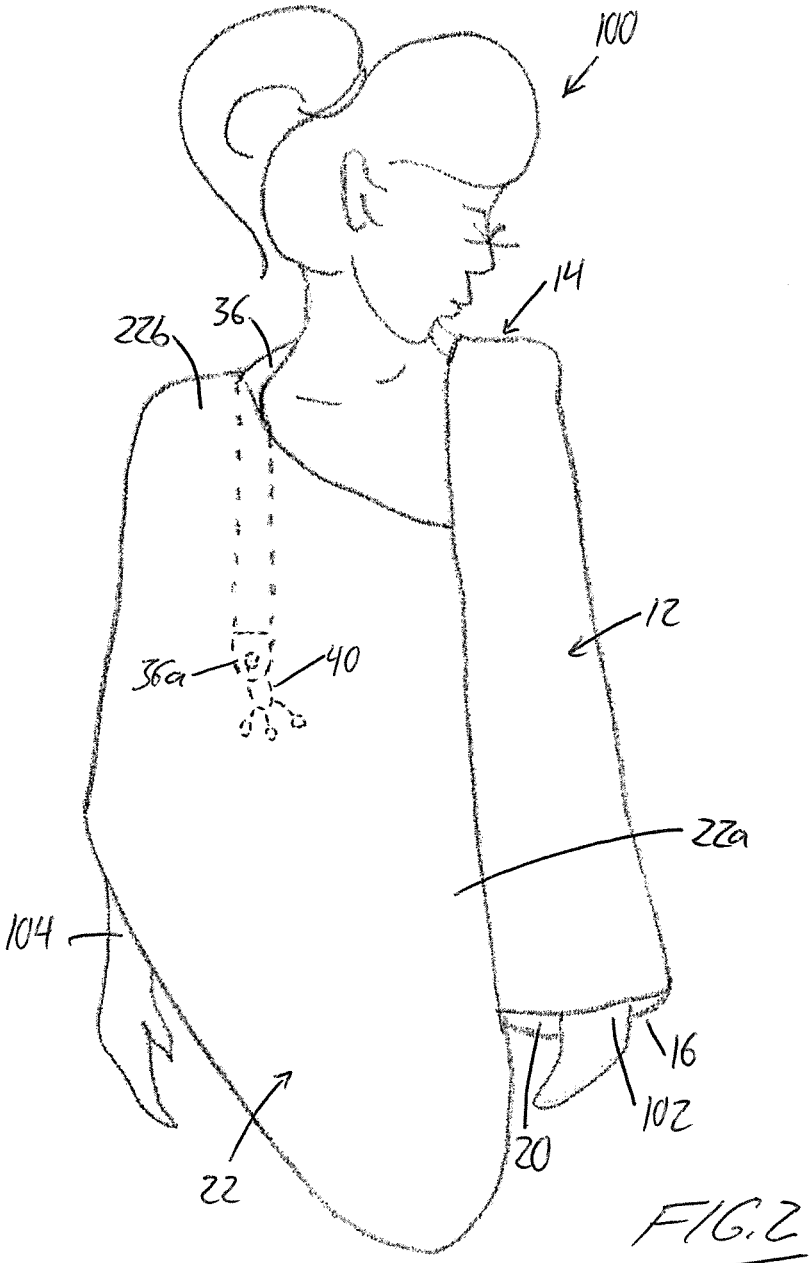
FIG. 2 is a front elevational view of the sleeved blanket of FIG. 1.

Having described the general form of the sleeved blanket 10, attention is now turned to donning thereof by an infant's caregiver 100 in FIGS. 1 and 2. The first end 14 of the single sleeve 12 is pulled over a first arm 102 of the caregiver, or alternatively, the first arm 102 of the caregiver arms is passed through the sleeve's first opening and onward through a hollow interior space that longitudinally spans between the two openings at the ends of the sleeve until the respective hand of the caregiver exits the sleeve 12 through the second sleeve opening 20. At this point, the hand now situated externally beyond the end of the sleeve is uninterrupted and free of any sleeve material, and likewise free of any blanket material since the blanket is offset to the side of the sleeve and terminates generally in-line with the second end thereof. The sleeve is long enough to substantially span the full length of the caregiver's arm from the shoulder thereof to the forearm or wrist. The sloped and notched first end 14 of the sleeve forms a shoulder-worn area of the sleeve, where the notch or cut-out 38 enables folding of the longer side 34 of the sleeve inwardly over the caregiver's shoulder, so that this shoulder-worn area effectively hooks the sleeve in place in a worn position on the caregiver's first arm.

The neck strap 36 is pulled behind the neck and laid thereacross at the posterior side thereof, and then draped forwardly (anteriorly) over the opposite shoulder 106 (i.e. the shoulder of the caregiver's unsleeved second arm 104). The weight of the strap hanging downwardly at the front (anterior) of the torso on the side of the neck opposite the sleeve helps balance and maintain the sleeve in the worn position on the first arm. At or near the free end of the neck strap 36 that resides opposite of the neck strap's connection to the sleeve 12, the neck strap 36 may feature a coupling element for removable attachment of a toy or accessory 40 (e.g. soother/pacifier) thereto for the infant to play with, hold or suck on. The toy/accessory may be hooked to the neck strap through a hole, grommet, a button or a closed loop formed by a folded-over and sewn end of the strap, any of which may thereby define the coupling element. As another example, the coupling element may be in the form of a clip attached to the neck strap for releasable clipping of the toy/accessory thereto. Additionally or alternatively, the neck strap may feature a piece of material 36*a* carried thereon at or near the free end thereof that is tactilely distinct from the strap material itself in order to provide tactile stimuli to the infant who may grasp or suck on this tactile area of the strap when the infant is cradled in the arms of the caregiver. The sleeve, blanket and neck strap may be made of the same material as one another, with the tactile piece 36*a* being of a different material. In one example, the tactile piece is made of silk or satin to provide a smooth soft feel that is differentiated from a thicker, more frictional and robust material used for the rest of the sleeved blanket so as to provide durability and warmth. This piece of tactile material may be sewn in a closed loop and used to attach the aforementioned toy or accessory to the neck strap. As an alternative to a separate piece attached to the neck strap, the entirety of the neck strap may be made of a material of different tactile character than the sleeve and blanket.

Figure 3:
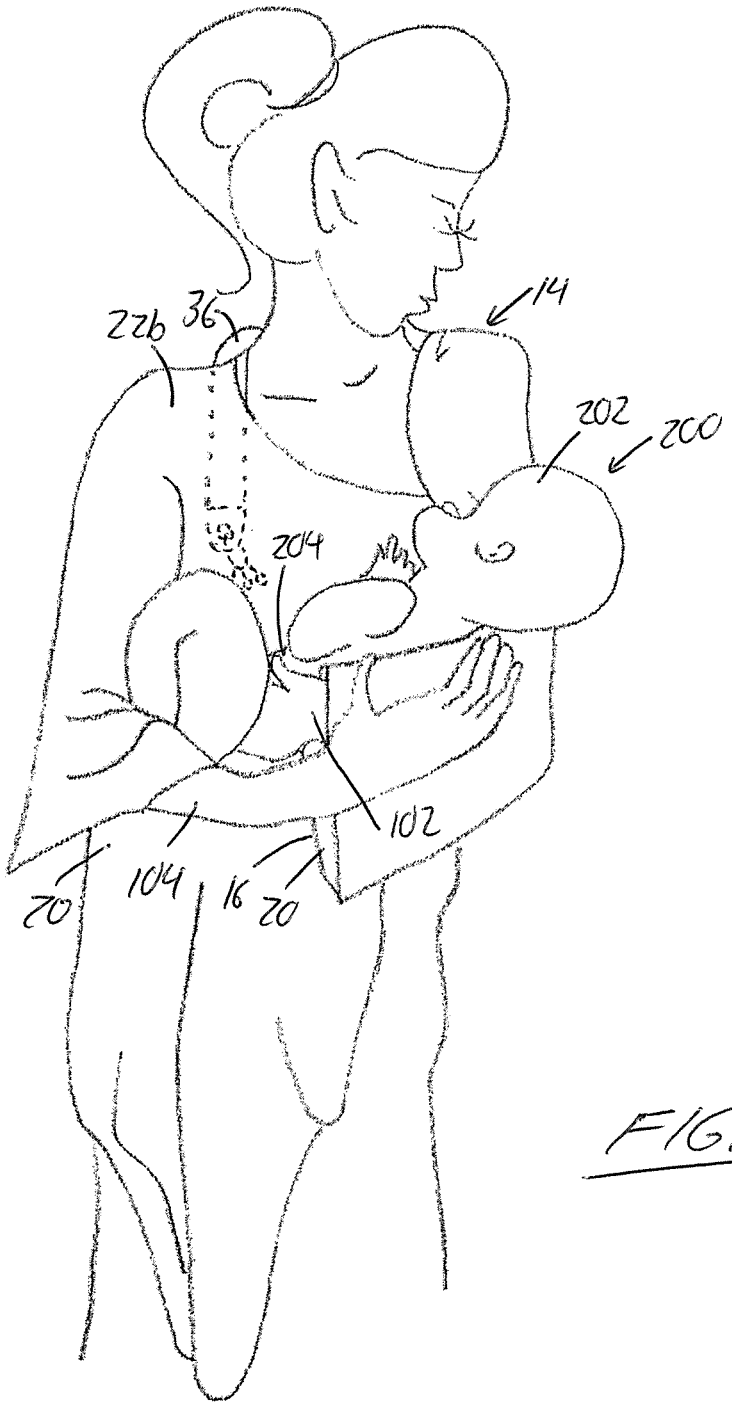
FIG. 3 is a front elevational showing the sleeved blanket of FIG. 2, with an infant cradled in the caregiver's arms in an exposed position, and the blanket extension still slung over the caregiver's shoulder.
Figure 4:
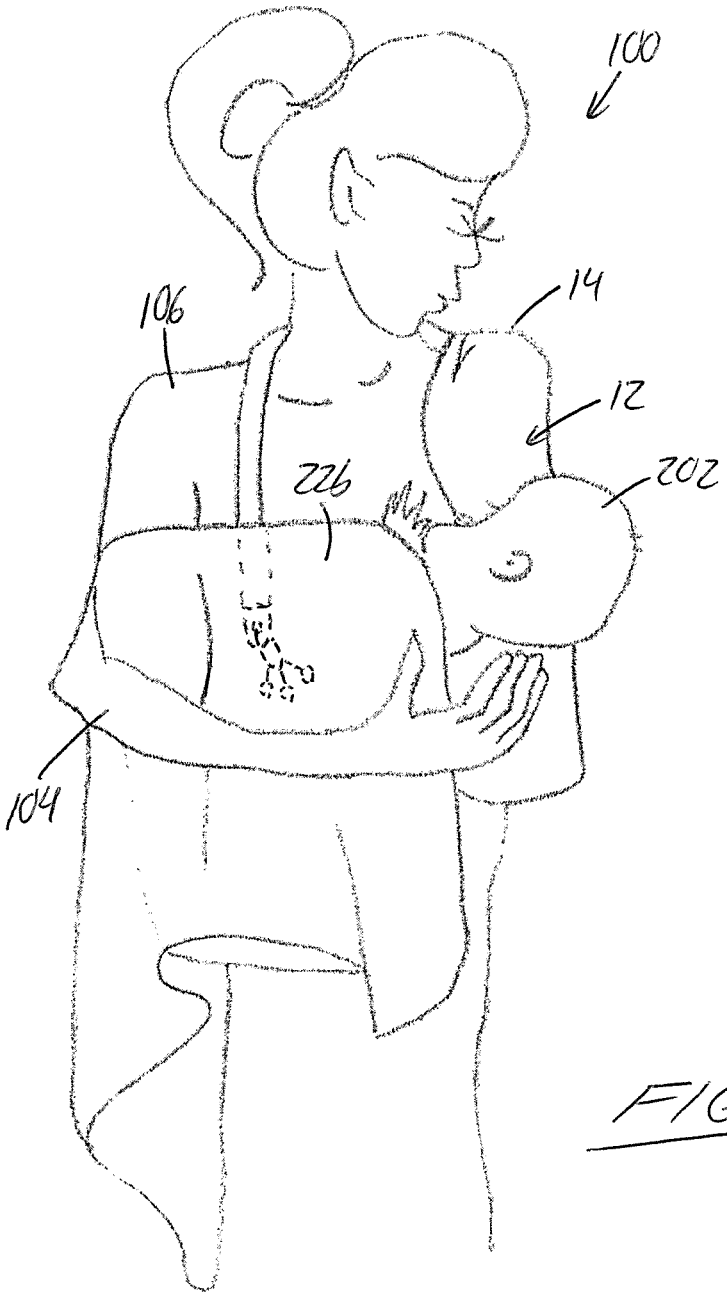
FIG. 4 is a front elevational view showing wrapping of the infant in the sleeved blanket of FIG. 2 by lowering of the blanket extension from its shoulder-slung position down over the infant.

Having donned the sleeve and slung the neck strap across the neck and over the opposing shoulder, the blanket extension 22*b* is now slung or placed posteriorly over the caregiver's opposing shoulder (i.e. shoulder of the second arm 104) from the anterior torso such that the blanket body 22*a* reaches across the anterior torso of the caregiver from the sleeve to the blanket extension 22*b* that is now draped posteriorly over the opposing shoulder. This completes the sleeved blanket's ready position shown in FIGS. 1 and 2, where both hands are now freely available (uncovered by any material of the sleeved blanket) to enable safe and confident handling while picking up and transferring the infant 200 into a held position cradled in the caregiver's arms, as shown in FIG. 3. Here, the infant's head 202 rests on the worn sleeve 12 of the caregiver's first arm, while the infant's body 204 rests against the blanket body 22, which in turn, rests against the anterior torso area of the caregiver's body. The blanket extension 22*b* previously placed over the caregiver's opposing shoulder is now available to be pulled down over the infant's body to provide warmth and comfort, as shown in FIG. 4, and may be wrapped further under and around the infant for tighter swaddling thereof. It will be appreciated that the use of the sleeved blanket is not limited specifically to an arm-cradled position in which the infant is in a generally horizontal laying position with their head rested on the sleeved arm of the caregiver, and for example may be used to hold the infant in an upright position with the infant's head resting on either shoulder (i.e. sleeved or unsleeved shoulder) of the caregiver.

Figure 5:
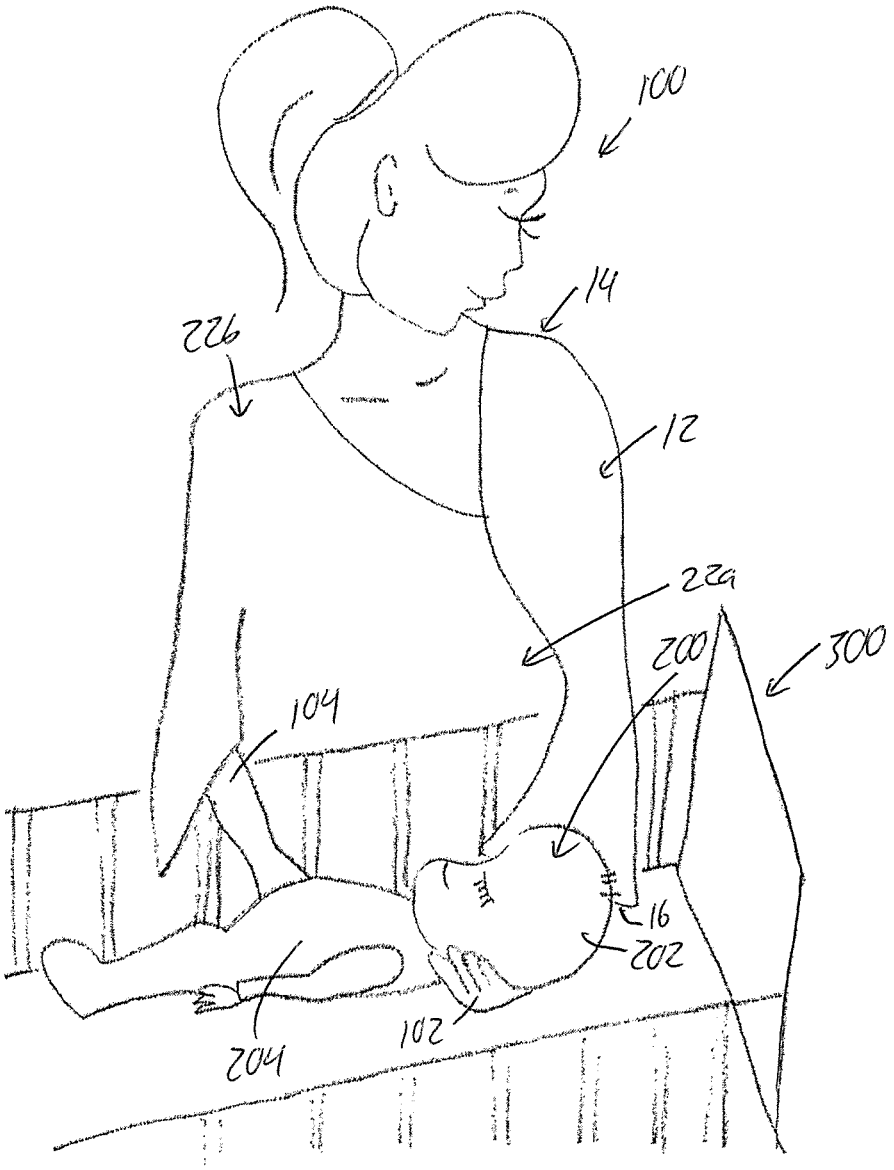
FIG. 5 is a front elevational view illustrating the act of bedding the infant by lifting the blanket extension back up into the shoulder-slung position to unwrap the child, and using two hands to gently place the child down onto a crib mattress or other sleeping surface.

Turning to FIG. 5, when the caregiver 100 is in the action of laying the infant 200 down in a crib 300 or other suitable bedding space, the infant is securely cradled in the sleeved first arm 102, and the caregiver uses the hand of the second unsleeved arm 104 to pull the blanket extension 22*b* upwardly from the infant and sling the blanket extension 22*b* back over the second shoulder 106 (i.e. the shoulder opposite the sleeved arm), thereby exposing the infant from the wrapped position. The caregiver is now able to handle the infant with both free hands while laying the infant down on the sleeping surface (e.g. crib mattress), without any of the blanket material wrapped or stuck in between the infant and the sleeping surface. The blanket stays with the caregiver before and after laying the infant down. In the end, the swaddling blanket 22 and pillow-like sleeve 12 are fully freed from the infant once the caregiver has laid the infant fully down on the sleeping surface, and the sleeved blanket remains attached to the caregiver via the arm-worn sleeve and the blanket extension draped over the opposing shoulder 106.

This sleeved blanket thereby helps caregivers to continue to use a safe blanket system and allows the caregivers to lay their infants down without leaving the blanket or pillow in the crib with the infant, and without worrying that they may wake the infant from its sleeping state during this transition, as the infant remains securely cradled in the sleeved arm of the caregiver while the attached blanket extension is gently removed from over or around the infant. The sleeved blanket thereby addresses the issues face by caregivers when using a standard blanket and then trying to lay the infant down while wrapped.

The illustrated embodiment features grip members 42 externally attached to the blanket extension near the distal end thereof that lies opposite to the blanket body (i.e. near the optionally-rounded first end 28 of the blanket 22), and similar grip elements 44 internally attached to the sleeve at the shoulder worn area thereof defined where the first end 14 and the outer side 34 of the sleeve meet together. Each grip member/element 42, 44 is a small piece of rubber, silicone, or other material of greater frictional coefficient than the fabric surface to which it is affixed. Accordingly, when the blanket extension 22*b* is slung over the caregiver's shoulder 106, the grip members 42 provide greater frictional interaction with the caregiver's skin or clothing than the blanket fabric itself, thereby providing improved resistance against falling of the blanket extension down from off the shoulder at the caregiver's anterior torso. Likewise, when the sleeve is worn with the shoulder area of the sleeve turned inwardly over the wearer's shoulder, the gripping elements 44 frictionally grip the wearer's skin or clothing to better resist sliding of the sleeve downwardly off the wearer's arm. The grip members/elements may be sticky or tacky to further contribute to this gripping action.

Figure 7:
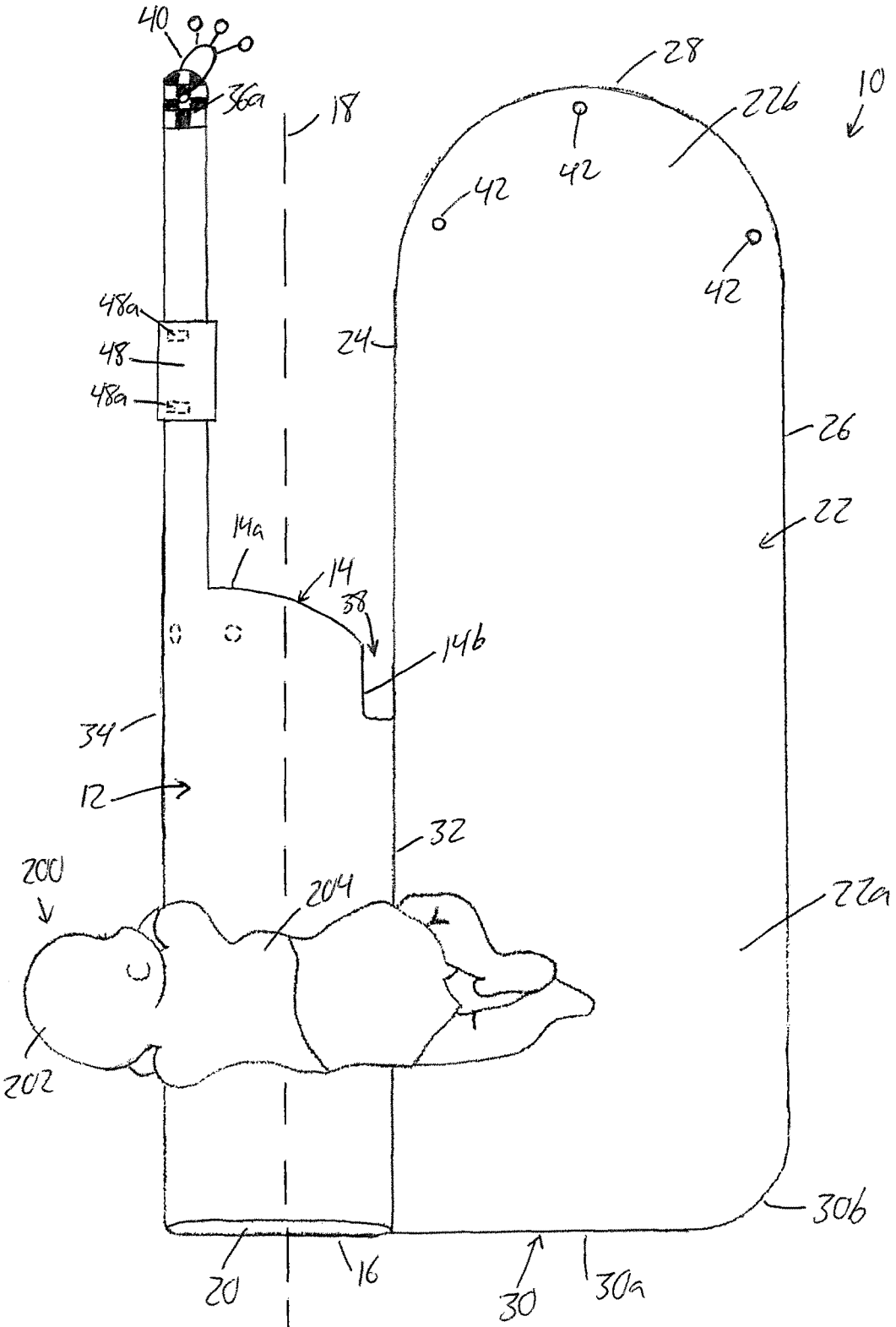
FIG. 7 is another an overhead plan view of the sleeved blanket laid out on the ground, but with an insert stuffed into the sleeve to create a torso-propping structure over which the infant can be laid chest-down in an alternate use of the sleeved product.

Turning to FIG. 7, the sleeved blanket 10 can also be used as a tummy time blanket. The blanket 22 lays flat on a floor surface to one side of the sleeve 12, and an insert (e.g. a pre-formed piece of foam or other preferably resilient material; or a rolled-up or bunched-up piece of flexible fabric) can be inserted into the hollow interior space of the sleeved blanket 12 in order to internally pack the sleeve into an expanded state from a normally self-collapsing state that would otherwise close off its interior space. The infant lays atop the sleeved blanket with his/her feet on the blanket body 22*a* and with his/her arms and torso spanning chest-down over the torso-propping bump that is created by the insert-packed or stuffed sleeve 12. The infant's head and torso are thus propped up off the flooring surface, which meanwhile remains accessible to the infant's hands. The extension 22*b* of the blanket 22 is used to either allow for extra play room for the infant, or to act as a cover pull over the infant for warmth.

The sleeve 12 can be made to have a loose or snug pre-determined size, or made with a stretchable material. The sleeve 12 can be adjustable, for example by use of hook and loop fasteners, pull strings or buttons at the wrist and/or armpit areas of the sleeve. Similarly, buttons or other fasteners can be used to make the sleeve fit more snugly or loosely at various locations along the longitudinal dimension of the sleeve. While the plan views shows the material as laying entirely flat, the material can alternatively be gathered and sewn in different spots, for example with a sleeve that is gathered or scrunched at one or more areas. The sleeved blanket may be styled like a single sleeved shirt with blanket attachment. The sleeve can be made from one or more pieces of fabric, and may be sewn in a pattern creating a shoulder similar to that found in a conventional shirt. Other embodiments may lack a shoulder area, and instead terminate prior to the shoulder, for example extending straight across from the wearer's armpit. The sleeve can be padded (e.g. with padding or stuffing between outer layers of fabric) or not padded, thereby varying the cushion effect and pillow-like quality of the sleeve. The neck strap of fabric or other material that runs behind the users neck or upper back may be selectively attachable and detachable to the blanket body 22*a* at or near to the free end of the strap to help keep the sleeve from slipping down the wearer's arm and to help keep the blanket body 22*a* in position on the wearer's chest. Alternatively, the free end may be free of any attachment to the blanket body, in which case the weight of the free hanging strap on one side of the user's neck still helps counteract falling of the sleeve from of the wearer's shoulder and slipping of the sleeve down the wearer's arm. So with its free end in either an attached or unattached state, the neck strap helps hold the sleeve in place. Alternatively, the neck strap may be omitted altogether without defeating other advantageous features disclosed herein.

Visual stimuli, for example in the form of a black and white pattern, may optionally be presented on the neck strap near the free end thereof, for example formed by black and white fabric pieces, black stitching on white fabric (or vice versa), or printing of black indicia or markings on a white fabric background (or vice versa), as black and white is known to provide visual stimulation to infants. The visual stimuli may be on the neck strap itself, or on the separate tactilely distinct material (e.g. silk or satin) attached thereto.

As shown in some of the figures, the neck strap may carry a removable burp/spit-up cloth 48, for example in the form of a piece of fabric material wrapped around the neck strap and removably attached thereto by snaps, buttons, hook and loop material, or other fasteners. In the illustrated example, the removable burp/spit-up cloth wraps fully around the neck strap 36 and attaches back onto itself, for example by way of snaps buttons, hook and loop material, or other fasteners 48*a* placed at four corners of a rectangular cloth, whereby the cloth can fasten upon itself when folded in half around the neck strap. In such instance, the burp/spit-up cloth is self-supporting by way its fastened closure around the neck strap, and is slidable up and down the strap between a useful position near the free end of the strap when needed, and a stowed position further up the strap when not required. The removability of the cloth is preferred to enable washing thereof separately of the reminder of the sleeved blanket, but other embodiments could feature a permanently attached cloth. The aforementioned visual stimuli may be provided on the cloth instead of directly on the strap or on the tactile stimuli (e.g. silk or satin piece).

While the illustrated embodiment is described as having a fixed attachment between the blanket and sleeve at a sewn longitudinal seam, other means of attachment, permanent or removable, may be employed, for example including zippers, buttons, hook and loop fasteners, ties, etc. A fixed or removable glove may be attached to the second end of the sleeve for wearing by the caregiver. Slits or other attachment means may be provided in the blanket for attaching toys or accessories thereto. The sleeve and blanket may each comprise single layer or multi-layer fabrics of various materials, filled or unfilled with stuffing or filling. As mentioned above, the blanket shape denoted by the perimeter edges of the blanket may be varied, including rounded, squared or triangular shapes. The blanket may or may not have trim (e.g. satin) along the perimeter thereof, or any other finish, decoration or ornamentation at edges or main surface area of the blanket on one or both faces thereof. While the illustrated blanket is described as being attached to the sleeve over the full length thereof, alternatively the blanket can be attached to only half of the sleeve, or any other fractional part of the sleeve.

Figure 8:
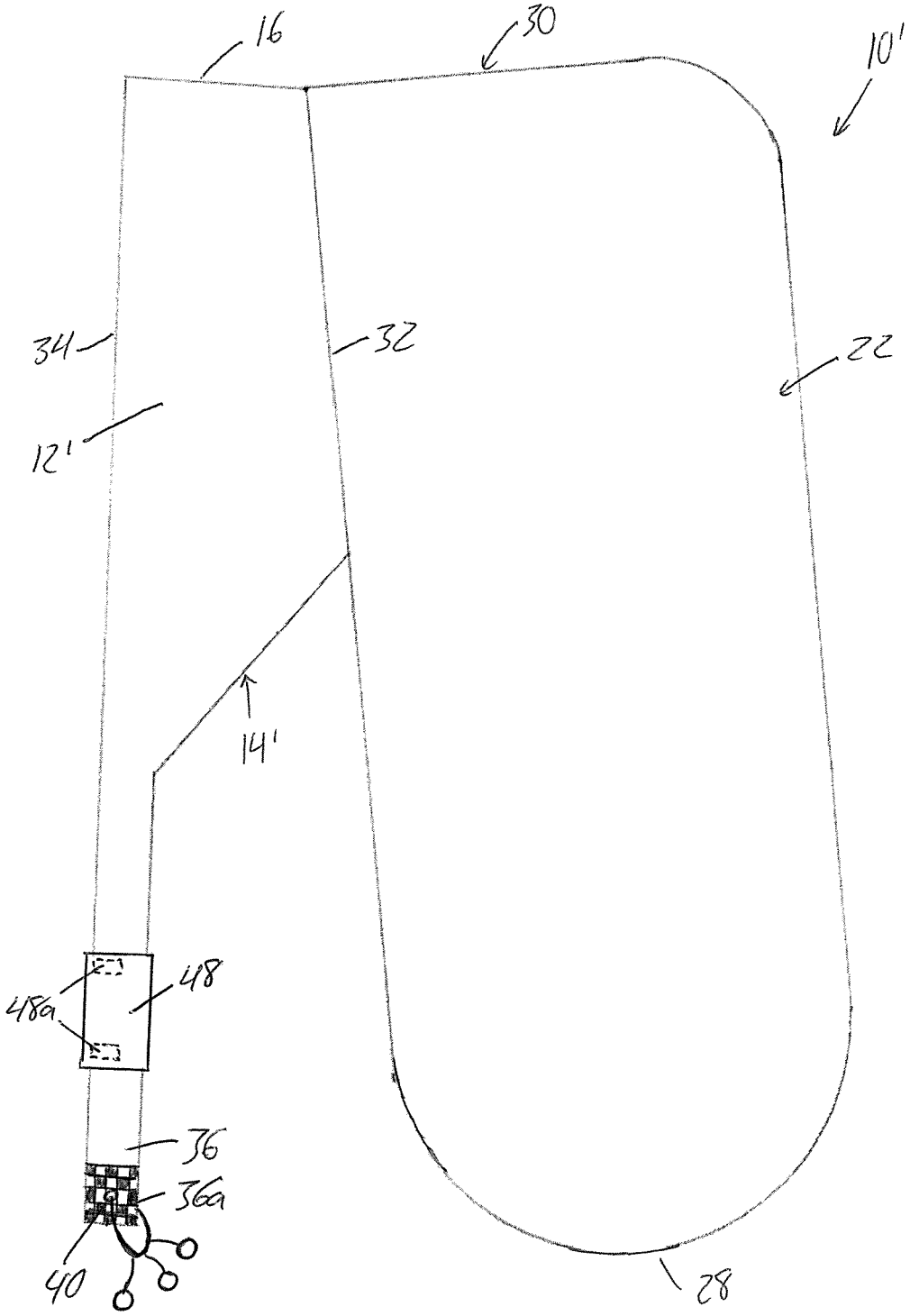
FIG. 8 illustrates a variant of the sleeved blanket with a different sleeve shape than that of FIG. 6.

FIG. 8 shows a slight variant of the sleeved blanket 10' in which the inner and outer sides of the sleeve 12' are not parallel to define a uniform sleeve width like that shown in FIG. 6, but instead converge at an oblique angle relative to one another toward the second end 16 of the sleeve. This provides the sleeve with a tapered shape that narrows in width toward the sleeve's second end 16 to better conform to the wrist or forearm of the wearer. Additionally, the sloped or angled first end 14' of the sleeve transitions linearly from the longer outer side of the sleeve to the shorter inner side thereof at an oblique angle instead of featuring the curved and notched/cutout profile of the sleeve end 14 shown in FIG. 6.

The sleeved blanket described herein above is also useful as a nursing cover.

Figure 9:
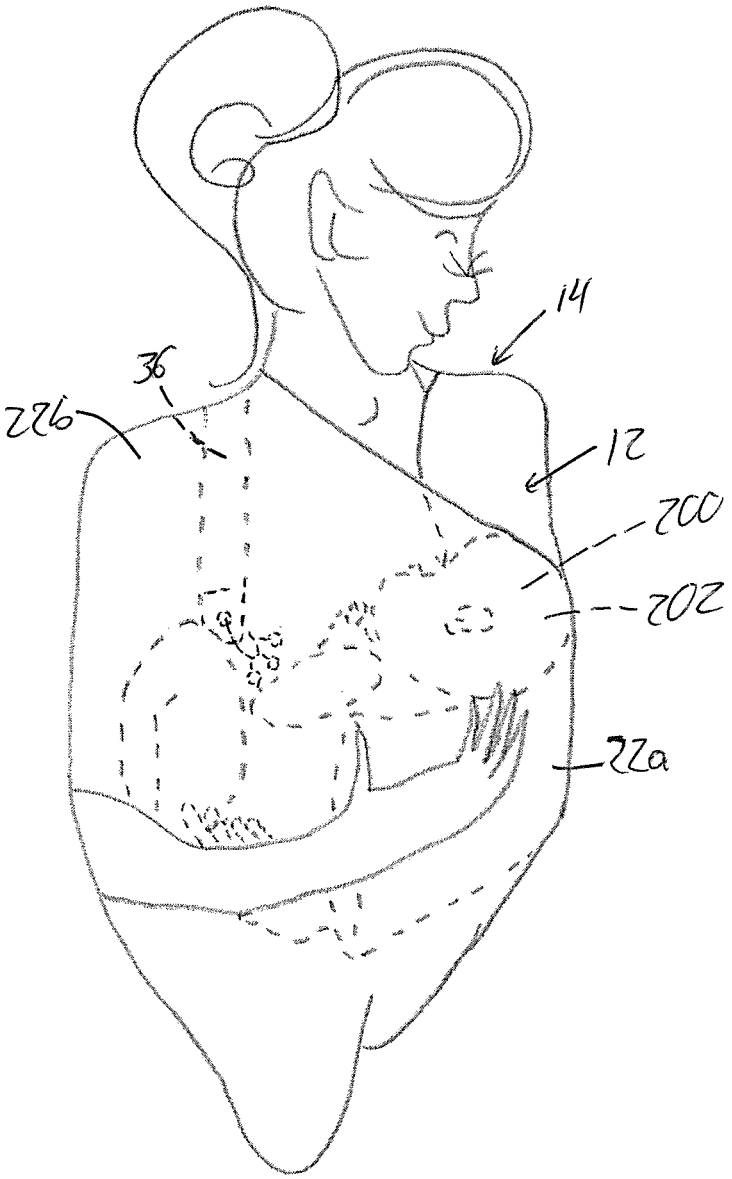
FIG. 9 illustrates use of the sleeved blanket in a nursing application for private breastfeeding of the infant.

In one nursing application, the sleeve is pulled onto one arm of the nursing mother and the neck strap passed across the backside of the neck and forwardly over the opposing shoulder to hang downwardly therefrom at the front torso. Initially the blanket is left to simply hang down from the sleeved arm, and the infant is lifted up and cradled in the sleeved arm of the nursing mother with the infant's head resting on same. At this point, the nursing mother uses the other hand of the unsleeved arm to reach across the torso around the child to near the armpit of the sleeved arm, where the blanket is grasped at or near the seam where it joins to the worn sleeve. The nursing mother slides her hand along the blanket, and pulls the blanket over the shoulder of the unsleeved arm to drape rearwardly over same, passing the blanket over the child as she does so in a manner concealing the infant's head and body behind the blanket against the mother's chest. This resulting state of the sleeved blanket is shown in FIG. 9, where it can be seen that privacy coverage of the infant is provided by the shoulder-slung blanket during nursing from the mother's breast. The worn position of the sleeved blanket in this mode of use is similar to the shoulder-slung position of FIGS. 1 and 2, except that this shoulder slinging of the blanket occurs after the child is picked up and cradled in the sleeved arm so that the child resides behind the shoulder slung position of the blanket for private nursing.

In a second nursing application, an arm of the nursing mother is not placed in the sleeve at all. Instead, the neck strap is passed across the backside of the neck from one side to the other, leaving the sleeve and attached blanket to hang down the front torso at one side thereof. The infant is picked up and cradled in the arm at the side of the torso at which the sleeve and blanket are hanging, and then using the other hand, the nursing mother pulls the blanket up, and pulls it over the child into a position slung over the other shoulder at which the neck strap hangs down the front torso. This blanket conceals the child in the similar manner to the first nursing application, but the sleeve remains unworn.

In a third nursing application, the blanket is initially laid over the two shoulders of the nursing mother across the back of the neck, like a shawl, so that the neck strap and the blanket hang down the front torso on opposite sides of the neck. The neck strap and blanket are tied together at the front torso, thereby creating a closed loop of the sleeved blanket around the mother's neck. This tied loop is then shifted around the torso to move the knot to the back of the neck, whereby the sleeve and blanket now hang down over the front torso from the shoulders, thereby providing coverage for the mother's chest. The child is then lifted up and cradled beneath the sleeve and blanket, thereby providing private nursing from the mother's breast behind the chest-coverage of the sleeve and blanket combination. As an alternative to tying the loop at the front torso and then turning the tied loop around the mother's neck, the mother may instead don the sleeved blanket like a bib, passing the sleeve and neck strap rearwardly over the shoulders and tying same together behind the neck.

Figure 10C:
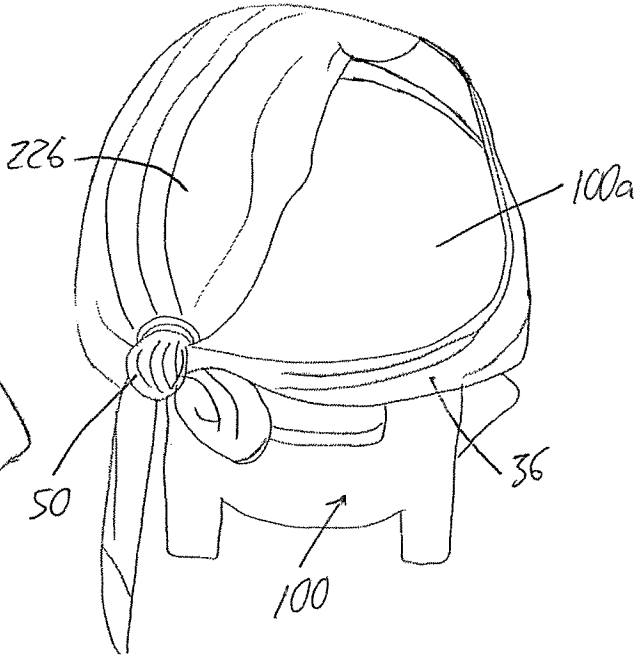
FIGS. 10A, 10B and 10C illustrate another application of the sleeved blanket as a cover for an infant car seat, where
Figure 10B:
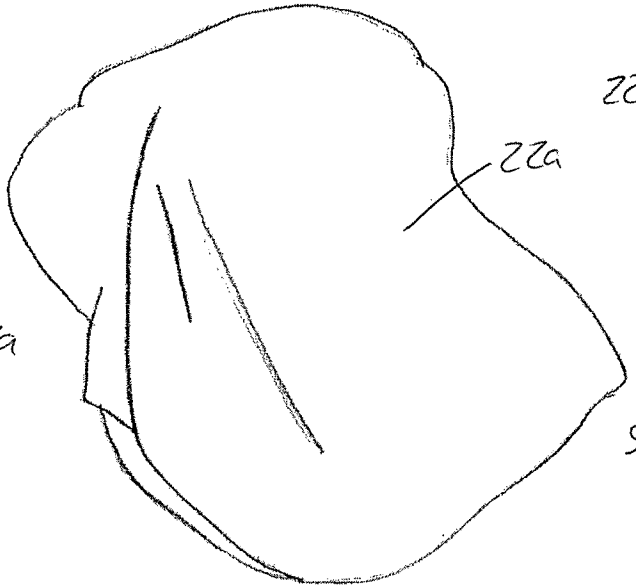
Figure 10A:
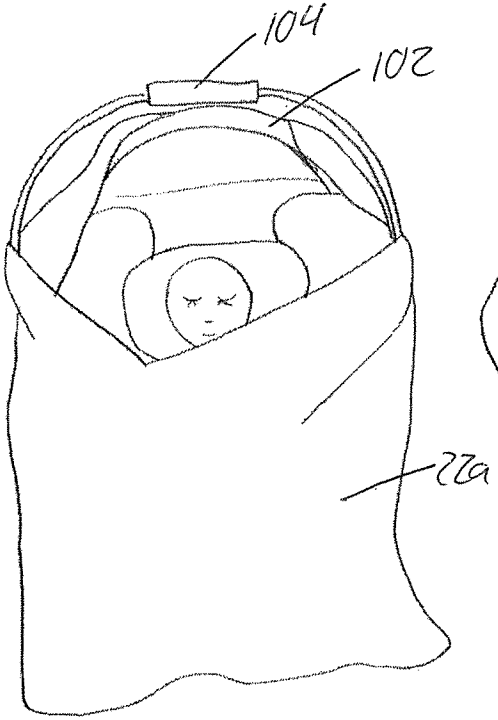

The sleeved blanket can also be used in car seat applications for fully or partially covering the normally-open top-front area of an infant car seat 100 for such purposes as helping insulate the infant from the cold, muffle outside sounds to reduce disturbance of a sleeping infant, and/or reduce exposure to sunlight, rain, snow, sleet, etc. during transfer between a vehicle and a home or other indoor space. In such applications, the blanket body 22*a* is laid out over the open top/front area of the car seat and the blanket extension 22*b* and the neck strap 36 are tied together in a knot 50 behind the rear side 100*a* of the infant car seat, as shown in FIG. 100. FIG. 10A shows the sleeved blanket in a partial-cover state over the front of the car seat, where the blanket body 22*a* is pulled down from the top rim 102 of the car seat to expose the child's face and allow the bail-style carry handle 104 normally stowed at said top rim to be pivoted off the rim 102 into a useful deployed position standing upright from the open top-front side of the car seat for carrying thereof. While the open space between the blanket body and the top rim of the car seat allows the handle to reach upward through this space, the body of child laid remains covered by the blanket body covering the remainder of the seat's open top/front side below the deployed handle. FIG. 10B shows the sleeved blanket in a full-cover state with the blanket body 22*a* pulled over the top rim and stowed handle of the car seat to span the entire top-front area thereof and fully conceal the infant therein.

Additional infant-holding applications of the sleeved blanket are shown in FIGS. 11A through 11D.

Figures 11A, 11B, 11C:
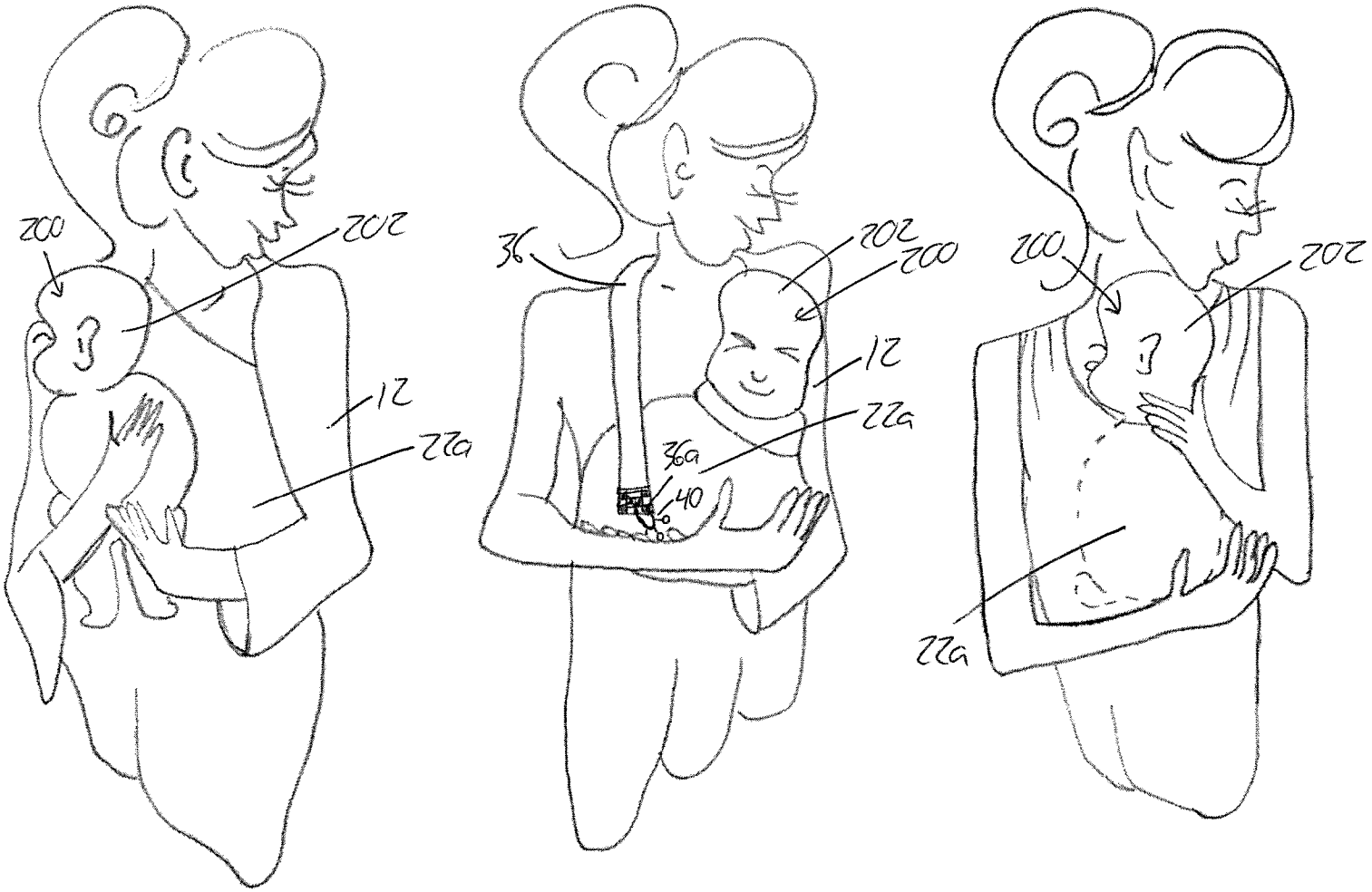
FIGS. 11A, 11B, 11C and 11D illustrate four additional modes of holding an infant with the sleeved blanket.

FIG. 11A shows holding of an infant with the sleeved blanket worn in the shoulder-slung position of FIG. 2, using both arms to hold the child against the softness of the blanket at the front torso of the caregiver at the side of the torso at which the blanket extension is slung over the shoulder, i.e. the non-sleeved side of the caregiver's body.

FIG. 11B shows a similar position to FIG. 4, with the infant's body wrapped in the blanket and the infant's head rested on the sleeved arm, but with the infant's torso in more of an upright seated position than a laid-down position, whereby the head of the infant rests against the sleeved arm near the shoulder thereof, rather than near the crook of the elbow. FIG. 11B also shows the neck strap 36 hanging down on the outside of the infant-wrapped blanket, rather than between the blanket and the caregiver's torso, whereby the infant has visual and and/or tactile access to the stimuli 36*a*, 40 on the neck strap.

FIG. 11C shows a position similar to the third nursing application mentioned above, with the sleeved blanket worn like a shawl with the blanket extension and neck strap tied together behind the caregiver's neck, with the blanket draped over the torso of the infant to cover the infant's torso between the blanket and the front torso of the caregiver. In the nursing context, the infant would be cradled in a laid-down position across the front torso of the caregiver under full cover of the blanket for access to the mother's breast, whereas in FIG. 11C the child is instead held upright against the front torso of the caregiver with the infant's head exposed outside and above the blanket in front of the caregiver's neck or upper chest, with the infant's torso cradled from beneath with one arm, and the rear of the infant's neck supported by the other hand of the caregiver.

Figure 11D:
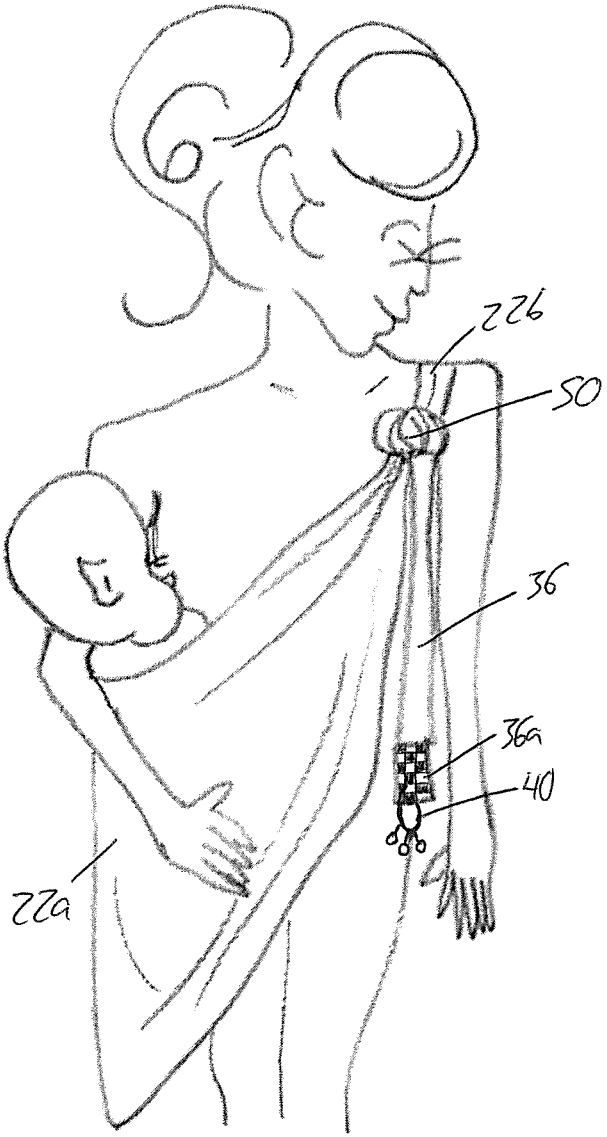

FIG. 11D shows another infant-carrying application where, like in FIG. 11C, the neck strap and blanket extension are once again tied together so that the overall sleeved blanket forms a closed loop around the caregiver's body. However, in this case, the tied knot 50 between the blanket extension 22*b* and the neck strap 36 is shifted to reside generally at one shoulder, so that the blanket 22*a* drapes downwardly across the caregiver's front torso to approximately waist or hip height at the opposite side the torso from the shoulder-carried knot 50. The blanket extension reaches upwardly across the caregiver's back from waist/hip height at this side, and up and over the opposing shoulder to connect to the neck strap at knot 50. The neck strap 36 singly hangs down along the torso at the same side thereof as the knot-carrying shoulder. In this position, the blanket serves as a sling spanning diagonally across the caregiver's front torso, enabling the infant ride in the sling against the caregiver's torso in a generally upright position with the infant's head at approximately armpit level at the unadorned shoulder opposite the knotted closure of the blanketed sleeve. As shown, the child's lower body may be held securely against the torso at approximately waist, hip or abdominal height using the hand of the arm whose shoulder is unadorned by the sleeved blanket.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A method of using a sleeved blanket to hold and bed an infant, the method comprising:

(a) possessing of the sleeved blanket by a caregiver, the sleeved blanket comprising a sleeve and a blanket attached thereto; wherein the sleeve has first and second ends spaced apart in a longitudinal direction and a hollow interior spanning longitudinally between a first opening at the first end of the sleeve and an second opening at the second end of the sleeve; and the blanket spans laterally outward from the sleeve to one side thereof, and comprises a main blanket body attached to the sleeve over a longitudinal span thereof and a blanket extension joined to the main body at an end thereof nearest the first end the sleeve, the extension reaching beyond the first end of the sleeve in the longitudinal direction (b) wearing of the sleeve in a worn position on one arm of the caregiver and the infant's body covered by or wrapped in the blanket attached to said sleeve;

(c) using the sleeved blanket to put the infant to bed by:

(i) withdrawing the blanket from the infant's body while leaving the infant's head in place on the sleeve worn on said one arm of the caregiver;

(ii) with the blanket removed from the infant's body, laying the infant down onto a sleep surface using two hands, including gently transferring the infant's head to said sleeping surface from the sleeve worn on said one arm of the caregiver;

(iii) with the sleeve remaining in the worn position, removing said two hands away from the infant laid on the sleeping surface, including withdrawing said one arm of the caregiver away from the infant laid on said sleeping surface, thereby simultaneously withdrawing both the sleeve and the blanket attached thereto.

2. The method of claim 1 wherein step (b) comprises donning the sleeve in the worn position on said one arm of the caregiver, laying the blanket extension over a shoulder of the caregiver that opposes said one arm on which the sleeve is worn, cradling the infant in said one arm of the caregiver with the infant's head on the sleeve worn on said one arm, and lowering said portion of the blanket from off said opposing shoulder and over the infant's body.

3. The method of claim 2 wherein step (c)(i) comprises lifting of the blanket from the infant's body and placing the portion of said blanket over the shoulder of the caregiver, and step (c)(ii) comprises leaving the portion of said blanket over said shoulder to keep the blanket free of said sleeping surface during placement of the infant thereon.

4. The method of claim 1 wherein step (c)(i) comprises lifting of the blanket from the infant's body and placing a portion of said blanket over a shoulder of the caregiver that opposes said one arm on which the sleeve is worn, and step (c)(ii) comprises leaving the portion of said blanket over said shoulder to keep the blanket free of said sleeping surface during placement of the infant thereon.

5. The method of claim 1 wherein step (b) comprises wearing a neck strap across the backside of the neck from the sleeve on said one arm and over a shoulder of the caregiver that opposes said one arm to help balance the sleeve in the worn position on said one arm.

6. The method of claim 1 comprising using a shoulder spanning portion of the sleeve to perform, or contribute to, retention of the sleeve in the worn position.

7. The method of claim 5 comprising, prior to step (c), stimulating the infant using one or more stimuli on the neck strap that is visually or tactilely accessible to the infant and visually or tactilely distinct from the sleeve and the blanket.

8. The method of claim 1 wherein an end of the main blanket body opposite the extension resides nearer to the second end of the sleeve than to the first end of the sleeve.

9. The method of claim 1 wherein the blanket terminates at or prior to the second end of the sleeve.

10. The method of claim 1 wherein a width of the blanket measured perpendicularly transverse to the longitudinal direction of the sleeve is less than a full length of the blanket in said longitudinal direction.

11. The method of claim 1 wherein the sleeved blanket comprises a neck strap attached to the sleeve at or adjacent the first end thereof for reaching across a neck of the caregiver at a posterior side thereof, and reaching anteriorly over a shoulder of a second arm of the caregiver.

12. The method of claim 11 wherein the sleeved blanket further comprises at least one of:

(i) visual stimuli on the neck strap at or adjacent a free end thereof that is distal to the sleeve for visual stimulation of the infant;

(ii) a material that is attached to or comprised by the neck strap and is tactilely distinct from the sleeve and the blanket to provide tactile stimuli to the infant;

(iii) a coupling element carried on the neck strap for selective attachment and detachment of a toy or accessory thereto and therefrom;

(iv) a toy or accessory attached to the neck strap;

(v) a fastening member on the neck strap operable to couple the neck strap to the blanket; and (vi) a burp or spit-up cloth attached to the neck strap.

13. The method of claim 12 comprising said burp or spit-up cloth, wherein the burp or spit-up cloth closes around the neck strap and is slidable back and forth therealong to adjust a position of the burp or spit-up cloth.

14. The method of claim 1 wherein the sleeved blanket comprises a gripping element mounted internally of the sleeve and having a higher coefficient of friction than an interior surface of the sleeve to which the gripping element is mounted to frictionally retain the sleeve in the worn position.

15. The method of claim 1 wherein the sleeved blanket is provided in combination with an insert that is (i) selectively insertable into the sleeve to achieve an expanded state thereof in which the first and second openings are obstructed by the insert and collapse of the hollow interior is blocked by the insert received therein, and (ii) selectively removable from the sleeve to enable self-collapse of the sleeve upon itself or receipt of a person's arm through the sleeve; whereby the sleeved blanket is usable in both the worn position and in a floor laid position with the sleeve in the expanded state to form a torso-propping support for an infant laid chest-down over the sleeve and attached blanket.

16. The method of claim 2 wherein the sleeved blanket comprises at least one grip member attached to the portion of the blanket laid over the shoulder of the caregiver, said at least one grip member having a greater coefficient of friction than a surface of said blanket on which said at least one grip member is disposed so as to frictionally retain said portion of the blanket over the shoulder of the second arm of the caregiver when laid thereover.

17. The method of claim 12 wherein the sleeved blanket comprises said coupling element carried on the neck strap.

18. The method of claim 12 wherein the sleeved blanket comprises said toy or accessory attached to the neck strap.

19. The method of claim 11 wherein the sleeved blanket comprises one or more stimuli on the neck strap that is and visually or tactilely distinct from the sleeve and the blanket for visual or tactile stimulation of the infant.

* * * * *